US011450987B2

(12) United States Patent
Su

(10) Patent No.: US 11,450,987 B2
(45) Date of Patent: Sep. 20, 2022

(54) ELECTRICAL CONNECTOR

(71) Applicant: Advanced Connectek Inc., New Taipei (TW)

(72) Inventor: Wen-Hui Su, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 0 days.

(21) Appl. No.: 17/204,928

(22) Filed: Mar. 17, 2021

(65) Prior Publication Data

US 2021/0296817 A1 Sep. 23, 2021

(30) Foreign Application Priority Data

Mar. 18, 2020 (TW) ..... 109203052

(51) Int. Cl.

| | |
|---|---|
| ***H01R 13/629*** | (2006.01) |
| ***H01R 24/60*** | (2011.01) |
| ***H01R 13/502*** | (2006.01) |
| ***H01R 13/516*** | (2006.01) |

(52) U.S. Cl.

CPC ..... *H01R 13/629* (2013.01); *H01R 13/502* (2013.01); *H01R 13/516* (2013.01); *H01R 24/60* (2013.01)

(58) Field of Classification Search

CPC ..... H01R 13/6593; H01R 13/6594; H01R 13/629; H01R 13/502; H01R 13/516; H01R 24/60

USPC ..... 439/607.27, 607.55

See application file for complete search history.

(56) References Cited

U.S. PATENT DOCUMENTS

| | | | | |
|---|---|---|---|---|
| 5,984,727 | A * | 11/1999 | Wu | H01R 13/502 439/607.02 |
| 7,837,506 | B1 * | 11/2010 | Chiang | H01R 12/707 439/607.27 |
| 10,468,831 | B2 * | 11/2019 | Zhao | H01R 24/62 |
| 2004/0242070 | A1 * | 12/2004 | Inoue | H01R 13/6582 439/607.01 |
| 2011/0256766 | A1 * | 10/2011 | Chiang | H01R 13/6595 439/607.27 |
| 2014/0073184 | A1 * | 3/2014 | Zhao | H01R 13/6594 439/607.55 |
| 2016/0079713 | A1 * | 3/2016 | Yu | H01R 13/6582 439/607.27 |
| 2018/0366862 | A1 * | 12/2018 | Zhao | H01R 13/6593 |
| 2019/0044268 | A1 * | 2/2019 | Huang | H01R 13/506 |
| 2021/0296812 | A1 * | 9/2021 | Su | H01R 43/20 |

* cited by examiner

*Primary Examiner* — Gary F Paumen
(74) *Attorney, Agent, or Firm* — JCIPRNET

(57) ABSTRACT

An electrical connector including an insulating body, a plurality of terminals disposed in the insulating body, a first shell, and a second shell is provided. The insulating body has a front side and a rear side opposite to each other, and has a protruding portion located at the rear side. The first shell is sheathed on the insulating body to form an insertion space located at the front side. The second shell is superposed on the first shell and has a locking hole at the rear side, wherein the protruding portion is locked with the locking hole, such that the second shell is fixed to the insulating body.

20 Claims, 3 Drawing Sheets

ELECTRICAL CONNECTOR

CROSS-REFERENCE TO RELATED APPLICATION

This application claims the priority benefit of Taiwan application serial no. 109203052, filed on Mar. 18, 2020. The entirety of the above-mentioned patent application is hereby incorporated by reference herein and made a part of this specification.

BACKGROUND

Technical Field

The present disclosure relates to an electrical connector.

Description of Related Art

As the amount of data transmitted between electronic devices continuously increases, in order to provide users with a more user-friendly experience, the speed of transmitting signals between electronic devices increases. An electrical connector is an electronic signal communication bridge between different electronic devices, so it is frequently applied to various electronic devices with the above situation.

However, under the trend of downsizing electronic device bodies, the size of an electrical connector is required to be reduced. What follows is that it affects the structural stability of the electrical connector package on the circuit board, which is easy to gradually decrease as the number of times the electrical connector is used (connecting and plugging) increases.

Accordingly, how to effectively improve the structural strength of the electrical connector configurated on the circuit board under the above-mentioned trend is a problem that people skilled in the art need to consider and solve.

SUMMARY

The present disclosure provides an electrical connector. The protruding portion of the insulating body and the locking hole of the shell are locked to each other, thereby increasing the strength of assembling the shell and the insulating body.

In an exemplary embodiment, the electrical connector includes an insulating body, a plurality of terminals, a first shell and a second shell. The insulating body has a front side and a rear side, which are opposite to each other, and a protruding portion located on the rear side. The terminals are disposed in the insulating body. The first shell is sheathed on the insulating body to form an insertion space, and an opening of the insertion space are located on the front side. The second shell is superposed on the first shell and has a locking hole on the rear side. The locking hole is locked to the protruding portion, such that the second shell is fixed on the insulating body.

In an exemplary embodiment, the electrical connector includes an insulating body, a plurality of terminals, a metallic plate, a first shell and a second shell. The insulating body has a front side and a rear side, which are opposite to each other, and a protruding portion located on the rear side. The insulating body comprises a base portion and a tongue portion, wherein the tongue portion is the front side of the insulating body, the base portion is the rear side of the insulating body, and two depressed regions are respectively formed on two sides of the tongue portion. The terminals are disposed in the insulating body and partially disposed on two tongue surfaces of the tongue portion. The metallic plate is disposed in the insulating body, wherein two sides of the metallic plate are respectively and partially exposed on the two depressed regions formed on the two sides of the tongue portion. The first shell is sheathed on the insulating body to form an insertion space, and the insertion space are located on the front side. The second shell is superposed on the first shell and has a locking hole on the rear side. The locking hole is locked to the protruding portion, such that the second shell is fixed on the insulating body.

In an exemplary embodiment, the second shell has a ⊓-shaped body and a rear cover bent and extended from the ⊓-shaped body. The ⊓-shaped body surrounds a part of the insulating body, the rear cover covers the rear side of the insulating body, the locking hole is located on the rear cover, and the rear cover is fixed to the insulating body by locking the locking hole to the protruding portion.

In an exemplary embodiment, the second shell further has a locking portion bent and extended from the rear cover, the locking portion is bent toward the ⊓-shaped body and abuts the insulating body, and the locking hole extends from the rear cover to the locking portion.

In an exemplary embodiment, the locking portion is formed by stamping and bending the second shell to form a hollow portion between the ⊓-shaped body and the rear cover.

In an exemplary embodiment, the insulating body has a depression located on the rear side, the protruding portion is located in the depression, the locking hole is locked to the protruding portion, and the locking portion abuts the depression.

In an exemplary embodiment, the first shell and the ⊓-shaped body are superposed and locked to each other.

In an exemplary embodiment, the first shell exposes a depression of the insulating body, and the protruding portion is located in the depression.

In an exemplary embodiment, there is a gap between the rear cover and the two side wings of the ⊓-shaped body, respectively.

In an exemplary embodiment, the electrical connector is a socket electrical connector for being configured on a circuit board, wherein the second shell further has a plurality of pins, which are inserted into the circuit board.

In an exemplary embodiment, the electrical connector is a Type-C electrical connector.

Based on the electrical connector above, the first shell and the second shell are assembled to the insulating body respectively. The insulating body has the front side and the rear side, which are opposite to each other, and the first shell and the insulating body form the insertion space on the front side, the insulating body has a protruding portion located on the rear side, and the second shell has the locking hole on the rear side. Because the second shell is superposed on the first shell, during the process of assembling the first and second shells to the insulating body, the strength of combining the second shell and the insulating body may be increased by locking the locking hole and the protruding portion to each other. When plugging or unplugging with another electrical connector, the combination of the first and second shells and the insulating body as above can effectively resist the plugging force of the electrical connector at the insertion space, and the deformation of the first and second shells due to the insertion and removal force may be avoided.

DESCRIPTION OF THE EMBODIMENTS

Figure 1:
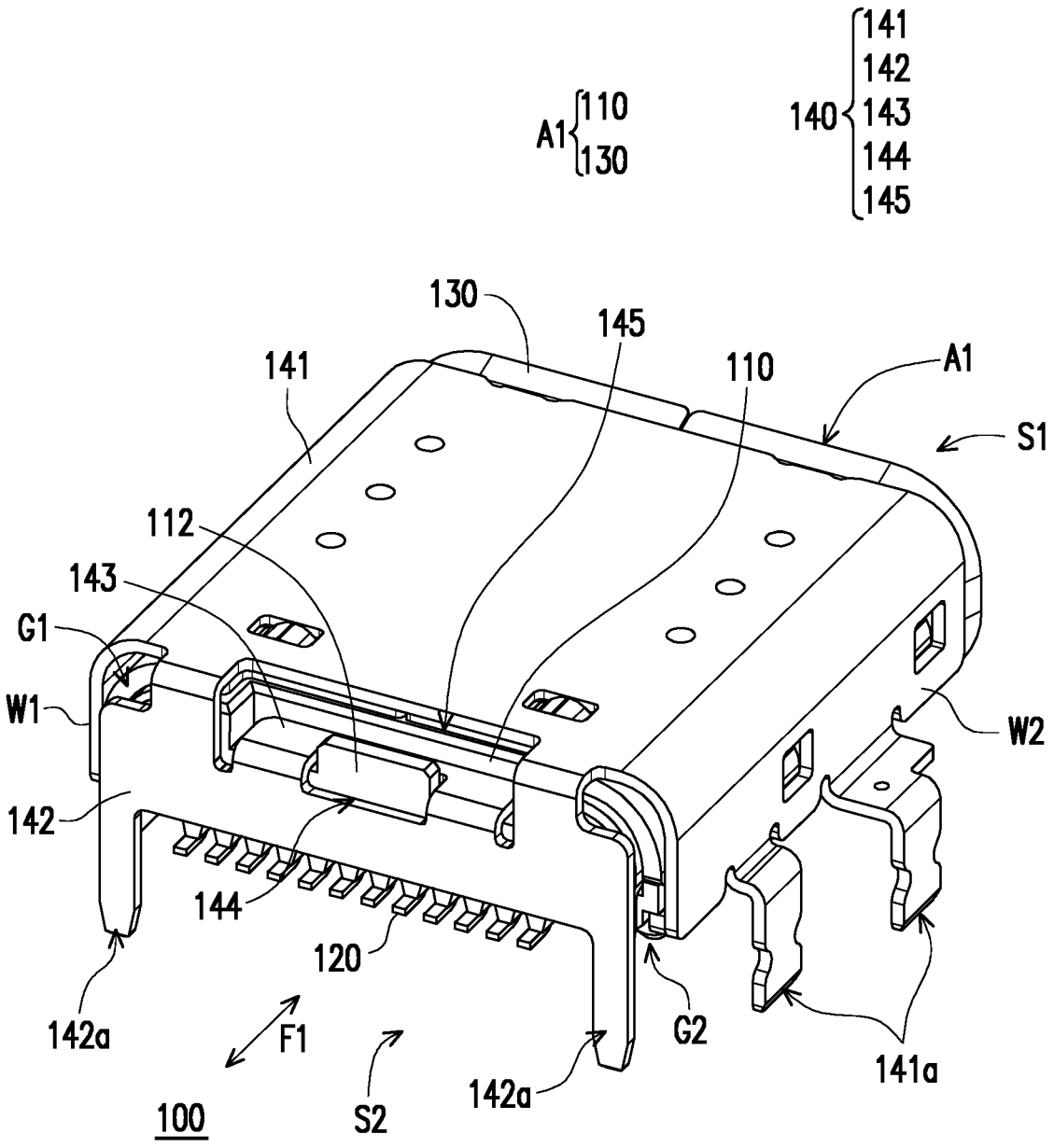
FIG. 1 is a schematic diagram of an electrical connector according to an exemplary embodiment.
Figure 2:
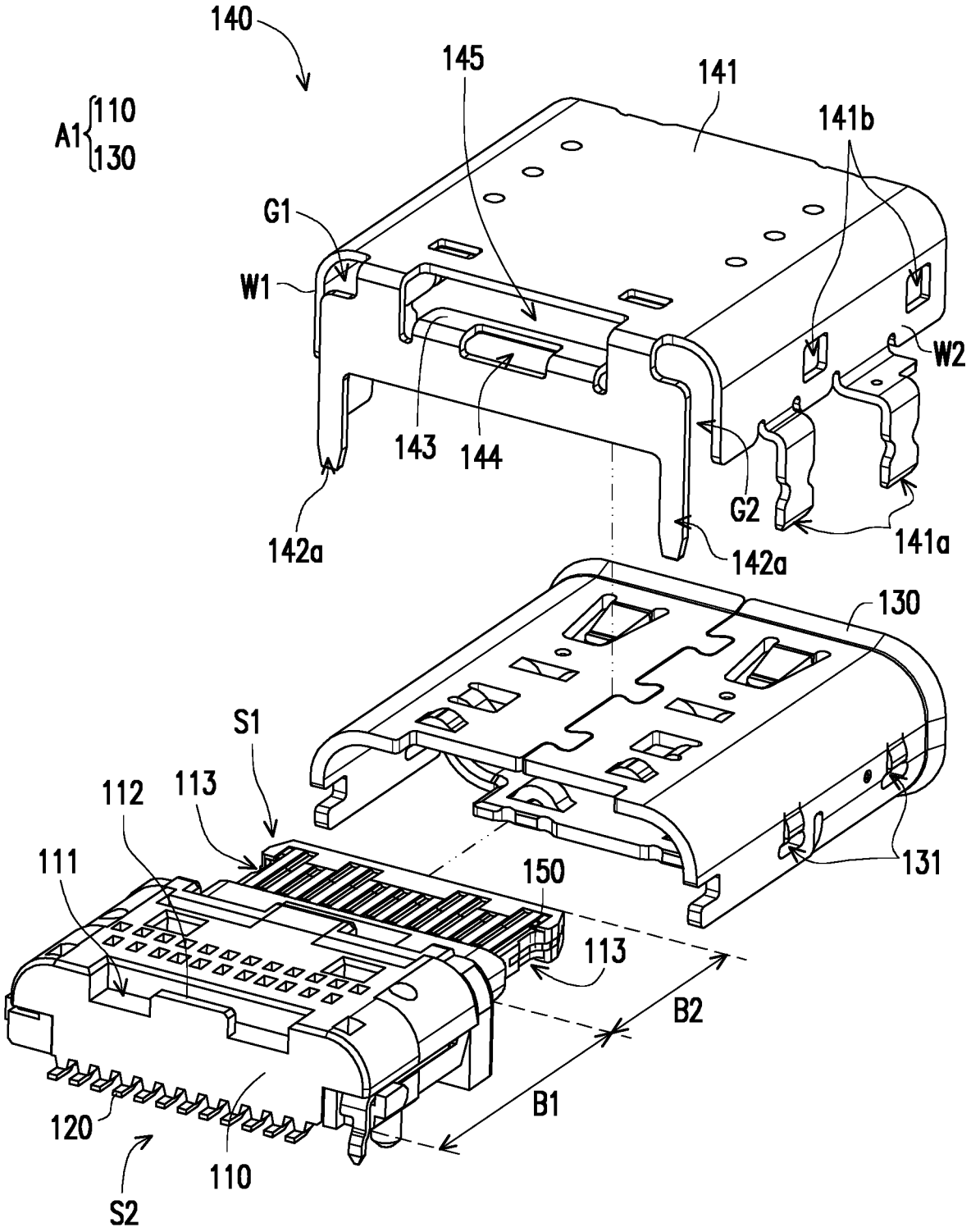
FIG. 2 is an exploded view of some components of the electrical connector of FIG. 1.

FIG. 1 is a schematic diagram of an electrical connector according to an exemplary embodiment, and FIG. 2 is an exploded view of some components of the electrical connector of FIG. 1. Referring to FIG. 1 and FIG. 2, in the present exemplary embodiment, the electrical connector 100 is, for example, a USB Type-C electrical connector, which includes an insulating body 110, a plurality of terminals 120, a first shell 130, a metallic plate 150, and a second shell 140. The insulating body 110 has a front side S1 and a rear side S2 disposed along the axial direction F1 and opposite to each other. The insulating body 110 also has a protruding portion 112 located on the rear side S2. The terminals 120 are disposed in the insulating body 110. The first shell 130 is sheathed on the insulating body 110 to form an insertion space Al, and an opening of the insertion space Al is located on the front side S1. The second shell 140 is superposed on the first shell 130, the second shell 140 has a locking hole 144, the locking hole 144 and the protruding portion 112 are located on the rear side S2 and opposite to the insertion space Al, wherein the locking hole 144 is locked to the protruding portion 112 to fix the second shell 140 on the insulating body 110. The insulating body 110 comprises a base portion B I and a tongue portion B2, wherein the tongue portion B2 is the front side of the insulating body 110, the base portion B1 is the rear side of the insulating body 110, and two depressed regions 113 are respectively formed on two sides of the tongue portion B2. The terminals 120 are partially disposed on two tongue surfaces of the tongue portion B2. The metallic plate 150 is disposed in the insulating body 110, wherein two sides of the metallic plate 150 are respectively and partially exposed on the two depressed regions 113 formed on the two sides of the tongue portion B2.

As shown in FIG. 2, the first shell 130 is sheathed on the tongue plate structure of the insulating body 110 to form the insertion space Al. After that, the second shell 140 is superposed on and locked to the first shell 130.

Furthermore, the second shell 140 has a ⊓-shaped body 141 and a rear cover 142 bent and extended from the ⊓-shaped body 141. The ⊓-shaped body 141 surrounds a part of the insulating body 110, the rear cover 142 is opposite to the insertion space Al, the locking hole 144 is located in the rear cover 142, and the rear cover 142 is fixed to the insulating body 110 by locking the locking hole 144 to the protruding portion 112. Moreover, the second shell 140 further has a locking portion 143 bent and extended from the rear cover 142, the locking portion 143 is bent toward the ⊓-shaped body 141 and abuts the insulating body 110, the locking hole 144 extends from the rear cover 142 to the locking portion 143 to correspond to the protruding portion 112.

In detail, the locking portion 143 is formed by stamping and bending the second shell 140 to form a hollow portion 145 between the ⊓-shaped body 141 and the rear cover 142. That is, the structure of the second shell 140 is stamped and bent to form the locking portion 143, and the removed structure is the hollow portion 145. Correspondingly, the insulating body 110 has a depression 111 located on the rear side S2 and opposite to the insertion space A1, the protruding portion 112 is located in the depression 111, the locking hole 144 is locked to the protruding portion 112, such that the locking portion 143 abuts the structural plane within the depression 111. Accordingly, the second shell 140 and the insulating body 110 may maintain a fixed relationship with each other in the axial direction F1 by locking the locking holes 144 and the protruding portions 112 of the insulating body 110 to each other, and the axial direction F1 is also equivalent to the plug/unplug axial direction of the electrical connector 100.

Additionally, in the present exemplary embodiment, the ⊓-shaped body 141 of the second shell 140 is sheathed on the first shell 130 to form a double-layer structure, and as shown in FIG. 2, the ⊓-shaped body 141 has opposite side wings W1 and W2 and the locking structures 141*b* on the side wings W1 and W2. Similarly, the opposite sides of the first shell 130 also have corresponding locking structures 131, so that the ⊓-shaped body 141 may be superposed smoothly and locked out of the first shell 130. The first shell 130 exposes the rear side S2 and the depression 111 of the insulating body 110, which facilitates the protruding portion 112 located at the depression 111 to be locked smoothly to the locking hole 144 of the second shell 140

Referring to FIG. 1 and FIG. 2 again, because the rear cover 142 and the locking portion 143 are structurally combined with the protruding portion 112 of the insulating body 110 through the locking hole 144, for the second shell 140, the rear cover 142 of the ⊓-shaped body 141 does not need to be additionally provided with a structure for interconnecting the side wings W1 and W2. That is, the rear cover 142 and the two side wings W1 and W2 of the ⊓-shaped body 141 in the present exemplary embodiment are in a separated state with gaps G1 and G2, respectively. This is because the connection relationship of structure between the rear cover 142 and the insulating body 110 has completed, thereby effectively reducing the possibility of deformation due to the connecting and plugging of the electrical connector 100.

Figure 3:
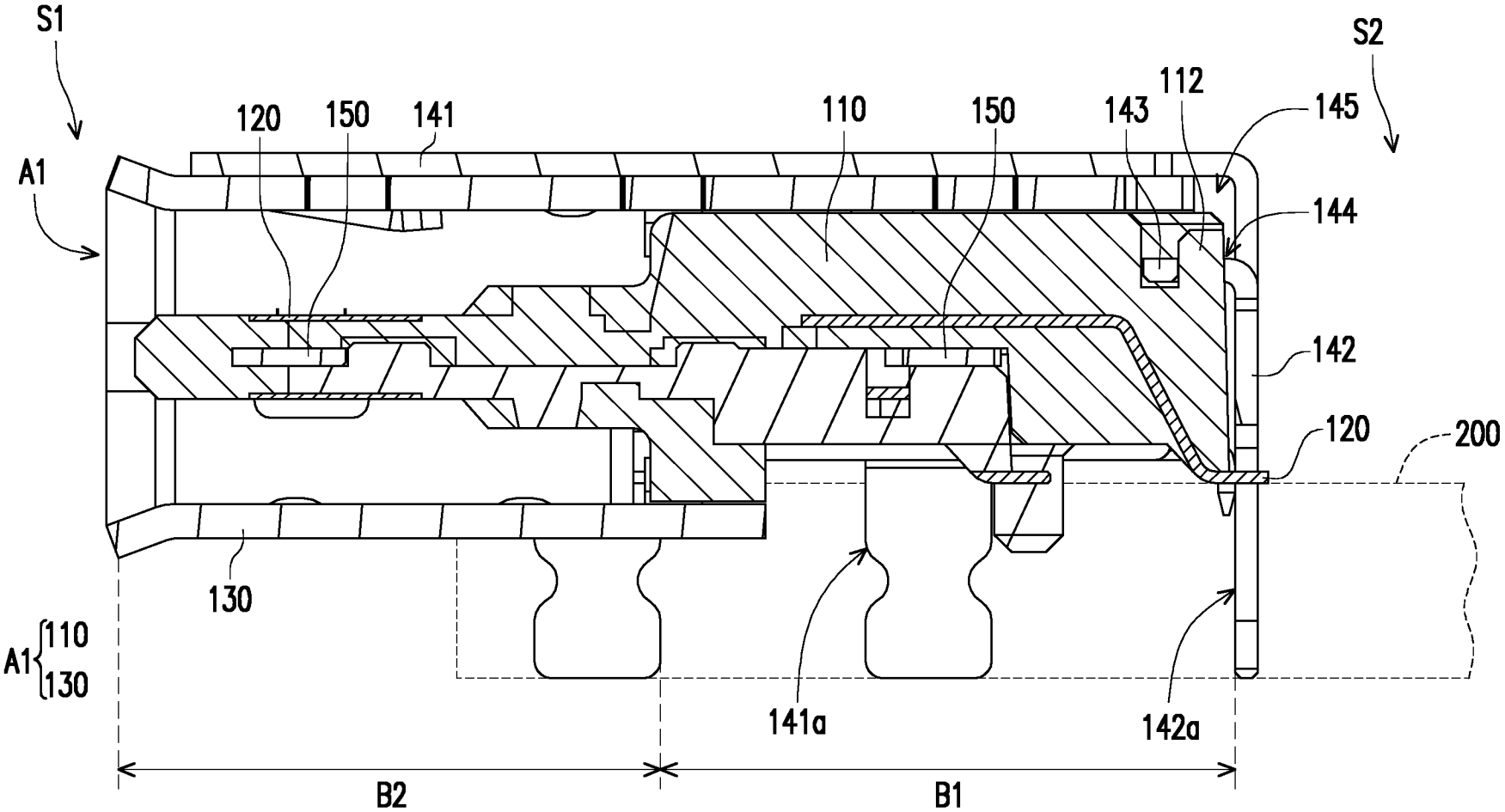
FIG. 3 is a cross-sectional view of the electrical connector of FIG. 1.

FIG. 3 is a cross-sectional view of the electrical connector of FIG. 1, and further illustrates the state of the electrical connector 100 disposed on the circuit board 200. Referring to FIG. 1 to FIG. 3, in the present exemplary embodiment, the ⊓-shaped body 141 of the second shell 140 further has a plurality of pins 141*a* disposed on the side wings W1 and W2, and the rear cover 142 of the second shell 140 also has a plurality of pins 142*a*. The pins 141*a* and 142*a* are used to be inserted into the circuit board 200 to achieve the effect of structural configuration and relative grounding. Furthermore, the ⊓-shaped body 141 and the rear cover 142 of the second shell 140 are directly structured and fixed to the circuit board 200, and thus the structural connection and fixing effect between the insulating body 110, the first shell 130, the second shell 140 and the circuit board 200 are completed, such that the structural strength of the insulating body 110, the first shell 130 and the second shell 140 can be considered as an integrated one, and it can more effectively resist the force of the electrical connector 100 due to the plugging and unplugging, and has better structural stability.

In summary, in the above-mentioned exemplary embodiments, the electrical connector is formed with a protruding portion on the opposite side of the insertion space by the insulating body, the second shell is also formed with a locking hole on the opposite side of the insertion space, such that during the process of sheathing the first shell to the insulating body and superposing on and locking the second shell to the first shell, the combined (fixed) strength of the first shell 130, the second shell 140 and the insulating body 110 may be increased by locking the locking hole and the protruding portion to each other. Furthermore, the second shell is further directly fixed on the circuit board by inserting a plurality of pins on the circuit board, thereby forming the integration structure of the insulating body, the first shell, the second shell and the circuit board.

Accordingly, when plugging or unplugging with another electrical connector, the combination of the first and second shells and the insulating body at the opposite side of the insertion space as above can effectively resist the plugging force of the electrical connector at the insertion space, and the deformation of the first and second shells due to the insertion and removal force may be avoided.

What is claimed is:

1. An electrical connector comprising:

an insulating body having a front side and a rear side opposite to each other, and a protruding portion located on the rear side;

a plurality of terminals disposed in the insulating body;

a first shell sheathed on the insulating body to form an insertion space, wherein an opening of the insertion space is located on the front side; and a second shell superposed on the first shell, wherein the second shell has a locking hole located on the rear side, and the locking hole is locked to the protruding portion, such that the second shell is fixed to the insulating body.

2. The electrical connector according to claim 1, wherein the second shell has a ⊓-shaped body and a rear cover bent and extended from the ⊓-shaped body, the ⊓-shaped body surrounds a part of the insulating body, the rear cover covers the rear side of the insulating body, the locking hole is located on the rear cover, and the rear cover is fixed to the insulating body by locking the locking hole to the protruding portion.

3. The electrical connector according to claim 2, wherein the second shell further has a locking portion bent and extended from the rear cover, the locking portion is bent toward the ⊓-shaped body and abuts the insulating body, and the locking hole extends from the rear cover to the locking portion.

4. The electrical connector according to claim 3, wherein the locking portion is formed by stamping and bending the second shell to form a hollow portion between the ⊓-shaped body and the rear cover.

5. The electrical connector according to claim 3, wherein the insulating body has a depression located on the rear side, the protruding portion is located in the depression, the locking hole is locked to the protruding portion, and the locking portion abuts the depression.

6. The electrical connector according to claim 2, wherein the first shell and the ⊓-shaped body are superposed and locked to each other.

7. The electrical connector according to claim 6, wherein the first shell exposes a depression of the insulating body, and the protruding portion is located in the depression.

8. The electrical connector according to claim 2, wherein gaps are formed between the rear cover and two side wings of the ⊓-shaped body.

9. The electrical connector according to claim 1, wherein the electrical connector is a socket electrical connector for being configured on a circuit board, wherein the second shell further has a plurality of pins inserted into the circuit board.

10. The electrical connector according to claim 1, wherein the electrical connector is a USB Type-C electrical connector.

11. An electrical connector comprising:

an insulating body having a front side and a rear side opposite to each other, and a protruding portion located on the rear side and the insulating body comprising a base portion and a tongue portion, wherein the tongue portion is the front side of the insulating body, the base portion is the rear side of the insulating body, and two depressed regions are respectively formed on two sides of the tongue portion;

a plurality of terminals disposed in the insulating body and partially disposed on two tongue surfaces of the tongue portion;

a metallic plate disposed in the insulating body, wherein two sides of the metallic plate are respectively and partially exposed on the two depressed regions formed on the two sides of the tongue portion;

a first shell sheathed on the insulating body to form an insertion space, wherein an opening of the insertion space is located on the front side; and a second shell superposed on the first shell, wherein the second shell has a locking hole located on the rear side, and the locking hole is locked to the protruding portion, such that the second shell is fixed to the insulating body.

12. The electrical connector according to claim 11, wherein the second shell has a ⊓-shaped body and a rear cover bent and extended from the ⊓-shaped body, the ⊓-shaped body surrounds a part of the insulating body, the rear cover covers the rear side of the insulating body, the locking hole is located on the rear cover, and the rear cover is fixed to the insulating body by locking the locking hole to the protruding portion.

13. The electrical connector according to claim 12, wherein the second shell further has a locking portion bent and extended from the rear cover, the locking portion is bent toward the ⊓-shaped body and abuts the insulating body, and the locking hole extends from the rear cover to the locking portion.

14. The electrical connector according to claim 13, wherein the locking portion is formed by stamping and bending the second shell to form a hollow portion between the ⊓-shaped body and the rear cover.

15. The electrical connector according to claim 13, wherein the insulating body has a depression located on the rear side, the protruding portion is located in the depression, the locking hole is locked to the protruding portion, and the locking portion abuts the depression.

16. The electrical connector according to claim 12, wherein the first shell and the ⊓-shaped body are superposed and locked to each other.

17. The electrical connector according to claim 16, wherein the first shell exposes a depression of the insulating body, and the protruding portion is located in the depression.

18. The electrical connector according to claim 12, wherein gaps are formed between the rear cover and two side wings of the ⊓-shaped body.

19. The electrical connector according to claim 11, wherein the electrical connector is a socket electrical connector for being configured on a circuit board, wherein the second shell further has a plurality of pins inserted into the circuit board.

20. The electrical connector according to claim 11, wherein the electrical connector is a USB Type-C electrical connector.

* * * * *